US010861382B2

(12) United States Patent
Hsieh et al.

(10) Patent No.: US 10,861,382 B2
(45) Date of Patent: Dec. 8, 2020

(54) PIXEL CIRCUIT AND REPAIR METHOD THEREOF

(71) Applicant: AU Optronics Corporation, Hsin-Chu (TW)

(72) Inventors: Hsiang-Yuan Hsieh, Hsin-Chu (TW); Min-Yao Lu, Hsin-Chu (TW); Ming-Chen Hsu, Hsin-Chu (TW); Chin-Tang Chuang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/591,969

(22) Filed: Oct. 3, 2019

(65) Prior Publication Data

US 2020/0251046 A1 Aug. 6, 2020

(30) Foreign Application Priority Data

Jan. 31, 2019 (TW) ..... 108103924 A

(51) Int. Cl.
*G09G 3/3233* (2016.01)
*G09G 3/3258* (2016.01)
(Continued)

(52) U.S. Cl.
CPC ..... *G09G 3/32* (2013.01); *G09G 3/006* (2013.01); *G09G 2300/0809* (2013.01);
(Continued)

(58) Field of Classification Search
CPC ..... G09G 3/32; G09G 3/3233; G09G 3/3241; G09G 3/3258; G09G 3/3291; G09G 3/006; G09G 2300/043; G09G 2300/0809; G09G 2300/0819; G09G 2310/0267; G09G 2320/0233; G09G 2320/0295; G09G 2320/043; G09G 2330/08; H01L 2251/568
See application file for complete search history.

(56) References Cited

U.S. PATENT DOCUMENTS 5,774,254 A * 6/1998 Berlin ..... G02B 26/0858 345/84
9,318,047 B2 * 4/2016 Hsu ..... G09G 3/3233
(Continued)

FOREIGN PATENT DOCUMENTS

CN 106504707 A 3/2017
CN 108648687 A 10/2018

*Primary Examiner* — Michael J Eurice
(74) *Attorney, Agent, or Firm* — WPAT, PC

(57) ABSTRACT

A pixel circuit includes a first lighting circuit, a second lighting circuit, and a compensation circuit. A first light emitting element of the first lighting circuit receives a first driving current when the first transistor switch of the first lighting circuit is turned on. The second light emitting element of the second light emitting circuit receives a second driving current when the second transistor switch of the second light emitting circuit is turned on. When the first light emitting element and the second light emitting element are driven by the first driving current and the second driving current, the compensation circuit provides a compensation current to the first light emitting element or the second light emitting element according to a difference in impedance between the first light emitting circuit and the second light emitting circuit.

17 Claims, 10 Drawing Sheets

(51) Int. Cl.
*G09G 3/32* (2016.01)
*G09G 3/00* (2006.01)

(52) U.S. Cl.
CPC ..... *G09G 2310/0267* (2013.01); *G09G 2320/0233* (2013.01); *G09G 2330/08* (2013.01)

(56) References Cited

U.S. PATENT DOCUMENTS

2003/0095087 A1* 5/2003 Libsch ..... G09G 3/3233 345/82
2005/0162737 A1* 7/2005 Whitehead ..... H04N 9/3102 359/454
2005/0179624 A1* 8/2005 Sun ..... G09G 3/3241 345/76
2005/0179626 A1* 8/2005 Yuki ..... G09G 3/3241 345/76
2007/0045620 A1 3/2007 Park et al.
2007/0195025 A1* 8/2007 Korcharz ..... H05B 45/46 345/82
2009/0135107 A1* 5/2009 Kim ..... G09G 3/3233 345/76
2011/0273420 A1* 11/2011 Liu ..... G09G 3/3233 345/211
2011/0273491 A1* 11/2011 Iida ..... G09G 3/3266 345/690
2012/0133673 A1* 5/2012 Ninan ..... G09G 3/3426 345/599
2012/0274622 A1* 11/2012 Huang ..... G09G 5/10 345/212
2012/0306843 A1* 12/2012 Wang ..... G09G 3/3258 345/212
2013/0314308 A1* 11/2013 Hsu ..... G09G 3/3233 345/82
2013/0342109 A1* 12/2013 Huang ..... H05B 47/10 315/127
2014/0332775 A1* 11/2014 Chang ..... G09G 3/3233 257/40
2015/0170578 A1 6/2015 Choi
2016/0086536 A1* 3/2016 Lin ..... G09G 3/3233 345/211
2016/0335954 A1* 11/2016 Hung ..... G09G 3/3233
2019/0156757 A1* 5/2019 Chang ..... G09G 3/3258
2019/0221635 A1* 7/2019 Iida ..... G09G 3/3266
2020/0154070 A1* 5/2020 Lin ..... H04N 5/374

* cited by examiner

PIXEL CIRCUIT AND REPAIR METHOD THEREOF

CROSS-REFERENCE TO RELATED APPLICATION

This application claims priority to Taiwan Application Serial Number 108103924, filed Jan. 31, 2019, which is herein incorporated by reference in its entirety.

BACKGROUND

Technical Field

The present disclosure relates to a pixel circuit, particularly including at least two light emitting elements for displaying the same pixel structure.

Description of Related Art

Micro LED Display is a micro LED array structure with self-luminous display characteristics. The advantages of Micro LED include high brightness, low power consumption, small size, high resolution and color saturation. Compared with other light emitting diodes, Micro LED not only has higher luminous efficiency and longer life, but also is not easily affected by the environment, so that Micro LED is more stable and can avoid image sticking.

However, because the volume of the Micro LED is extremely small, it is easy to cause a short circuit or an open circuit due to the influence of particles, so that the display panel has bright/dark spots or has an abnormal temperature. Therefore, it is an important discussion in the industry that detecting and repairing the miniature light emitting element, such as Micro LED, to ensure the circuit is normal.

SUMMARY

One aspect of the present disclosure is a pixel circuit. The pixel circuit includes a first lighting circuit, a second lighting circuit and a compensation circuit. The first lighting circuit comprises a first light emitting element and a first transistor switch. The first light emitting element receives a first driving current from a driving circuit when the first transistor switch is turned on. The second lighting circuit comprises a second light emitting element and a second transistor switch. The second light emitting element receives a second driving current from the driving circuit when the second transistor switch is turned on. The compensation circuit is electrically connected to the first light emitting element and the second light emitting element. When the first light emitting element and the second light emitting element are driven by the first driving current and the second driving current, the compensation circuit provides a compensation current to the first light emitting element or the second light emitting element according to a difference in impedance between the first light emitting circuit and the second light emitting circuit.

Another aspect of the present disclosure is a pixel circuit repair method. The pixel circuit repair method comprises the following steps. Turning on a first transistor switch of a first lighting circuit so that a first light emitting element is driven by a first driving current. Detecting a first detection voltage of the first lighting circuit. Turning on a second transistor switch of a second lighting circuit and turning off the first transistor switch of the first lighting circuit so that a second light emitting element is driven by a second driving current.

Detecting a second detection voltage of the second lighting circuit. Providing a compensation current to the first light emitting element of the second light emitting element through a compensation circuit according to a difference in impedance between the first light emitting circuit and the second light emitting circuit.

Another aspect of the present disclosure is a pixel circuit. The pixel circuit comprises a first lighting circuit, a second lighting circuit, a detection circuit and a compensation circuit. The first lighting circuit comprises a first light emitting element and a first transistor switch. When the first transistor switch is turned on, the first light emitting element receives a first driving current from a driving circuit. The second lighting circuit comprises a second light emitting element and a second transistor switch. When the second transistor switch is turned on, the second light emitting element receives a second driving current from the driving circuit. The detection circuit is electrically connected to the first lighting circuit and the second lighting circuit, and configured to detect a first detection voltage of the first lighting circuit and a second detection voltage of the second lighting circuit. The compensation circuit is electrically connected to the first lighting circuit and the second lighting circuit, and configured to provide a compensation current to the first light emitting element or the second light emitting element according to the first detection voltage and the second detection voltage.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
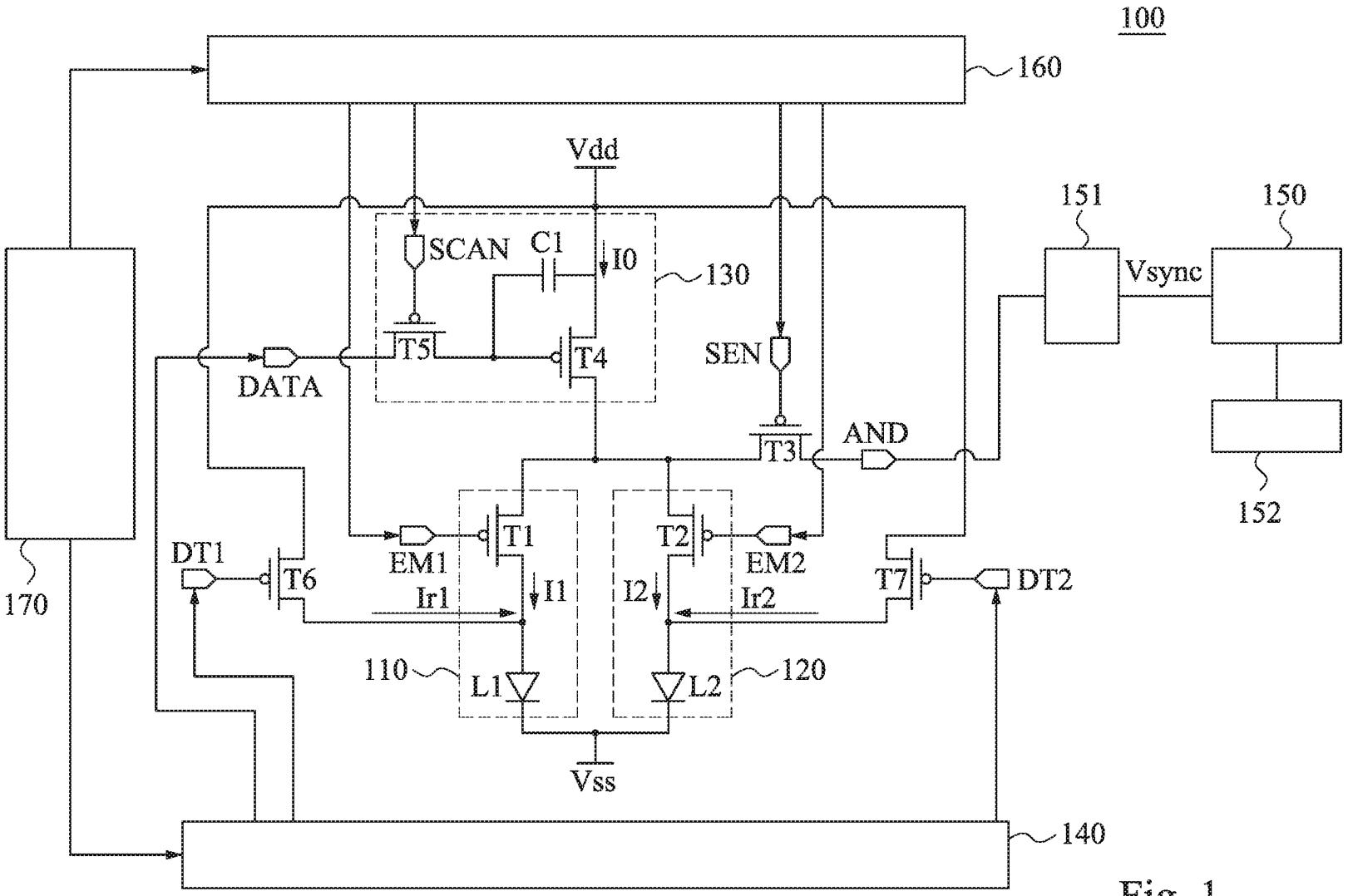
FIG. 1 is a schematic diagram of a pixel circuit in some embodiments of the present disclosure.

Referring to FIG. 1, the pixel circuit 100 includes a first lighting circuit 110, a second lighting circuit 120 a the driving circuit 130. The first lighting circuit 110 includes a first light emitting element L1 and a first transistor switch T1. In some embodiments, the first light emitting element L1 and the first transistor switch T1 are connected in series with each other. The first transistor switch T1 is electrically connected between the driving circuit 130 and the first light emitting element L1, so that when the first transistor switch T1 is turned on, the first light emitting element L1 receives a first driving current I1 from the driving circuit 130.

The second lighting circuit 120 includes a second light emitting element L2 and a second transistor switch T2. In some embodiments, the second light emitting element L2 and the second transistor switch T2 are connected in series with each other. The second transistor switch T2 is electrically connected between the driving circuit 130 and the second light emitting element L2, so that when the second transistor switch T2 is turned on, the second light emitting element L2 receives a second driving current I2 from the driving circuit 130.

In this embodiment, the light generated by the first light emitting element L1 and the second light emitting element L2 is used to display the same pixel. The first light emitting element L1 and the second light emitting element L2 may be micro LEDs, but the present disclosure is not limited thereto. The driving current I0 provided by the driving circuit 130 can be divided into the first driving current I1 and the second driving current I2. When anyone of the first light emitting element L1 and the second light emitting element L2 is damaged, the drive current I0 provided by the driving circuit 130 flows only through the normal one of the first light emitting element L1 and the second light emitting element L2.

The compensation circuit 140 is electrically connected between the first lighting circuit 110 and the second lighting circuit 120. When the first light emitting element L1 and the second light emitting element L2 are respectively driven by the first driving current I1 and the second driving current I2, the compensation circuit 140 is configured to selectively provide a compensation current (e.g., the first compensation current L1 or the second compensation current L2) to the first light emitting element L1 or the second light emitting element L2 according to a difference in impedance between the first lighting circuit 110 and the second lighting circuit 120.

In an ideal case, if the first light emitting element L1 and the second light emitting element L2 are the same type of light emitting elements (e.g., light emitting diodes), when the first transistor switch T1 and the second transistor switch T2 are turned on, the first driving current I1 will be same as the second driving current I2. However, in actual situations, the first light emitting element L1 and the second light emitting element L2 may have different impedance due to different process. Alternatively, the first light emitting element L1 and the second light emitting element L2 may have different impedance due to ohmic contact effects, resulting in the first driving current I1 being different from the second driving current I2. In the present disclosure, the compensation circuit 140 calculates a difference between the first driving current I1 and the second driving current I2 according to a difference in impedance between the first light emitting element L1 and the second light emitting element L2, based on voltage divider rule or current divider rule, to provide the compensation current, so that the first light emitting element L1 and the second light emitting element L2 maintain the same brightness. For example, if the first driving current I1 is less than the second driving current I2, the compensation circuit 140 provides the first compensation current L1 to the first light emitting element L1. On the other hand, if the first driving current I1 is larger than the second driving current I2, the second compensation current L2 is provided to the second light emitting element L2.

In some embodiments, the pixel circuit 100 further includes a scan driver 160 and a detection circuit 150. The scan driver 160 is electrically connected to a gate control terminal of the first transistor switch T1 and a gate control terminal of the second transistor switch T2 for controlling the opening and closing of the first transistor switch T1 and the second transistor switch T2. The detection circuit 150 is electrically connected to the first transistor switch T1 and the second transistor switch T2.

Figure 2:
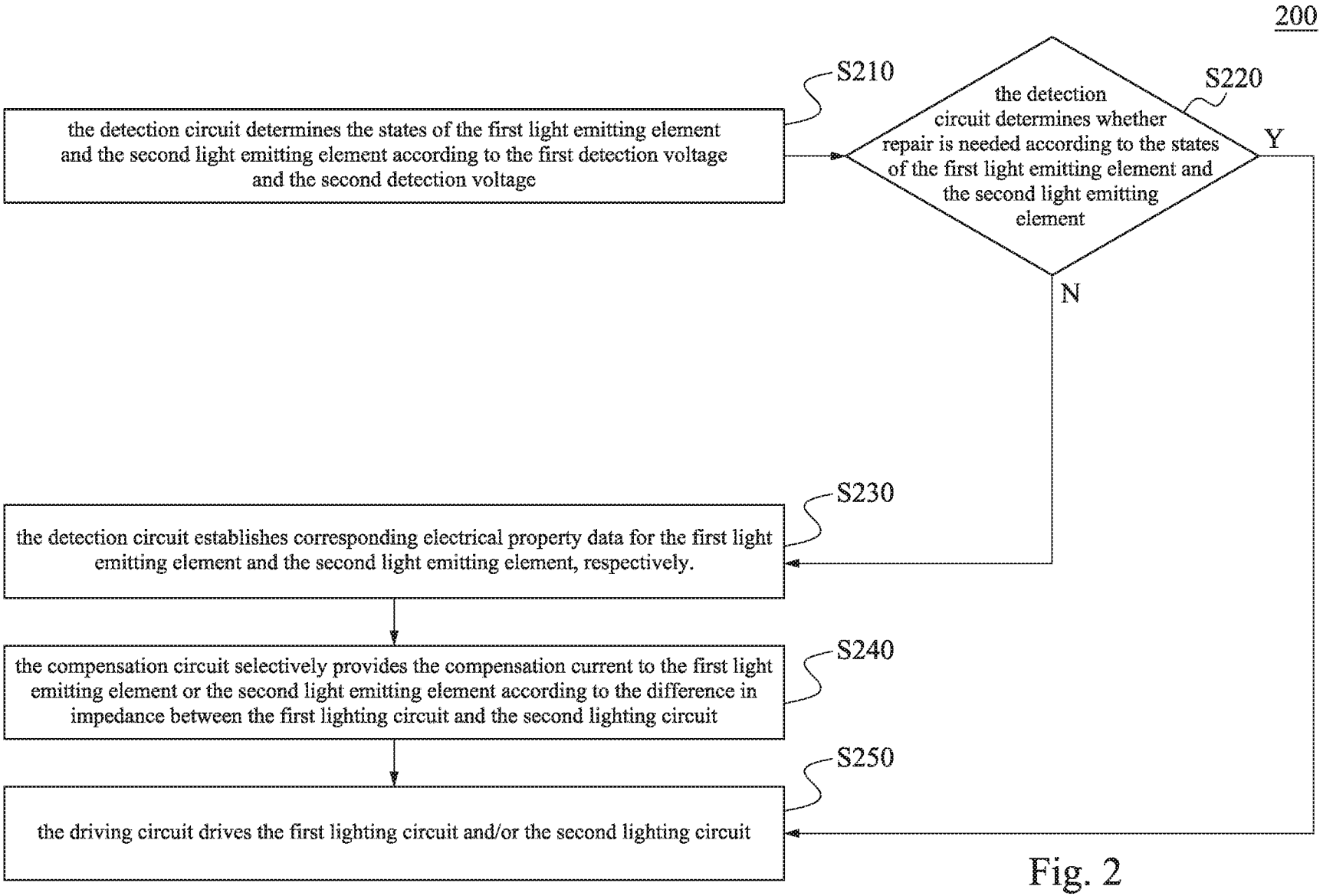
FIG. 2 is a schematic diagram of the pixel circuit repair method in some embodiments of the present disclosure.
Figure 3A:
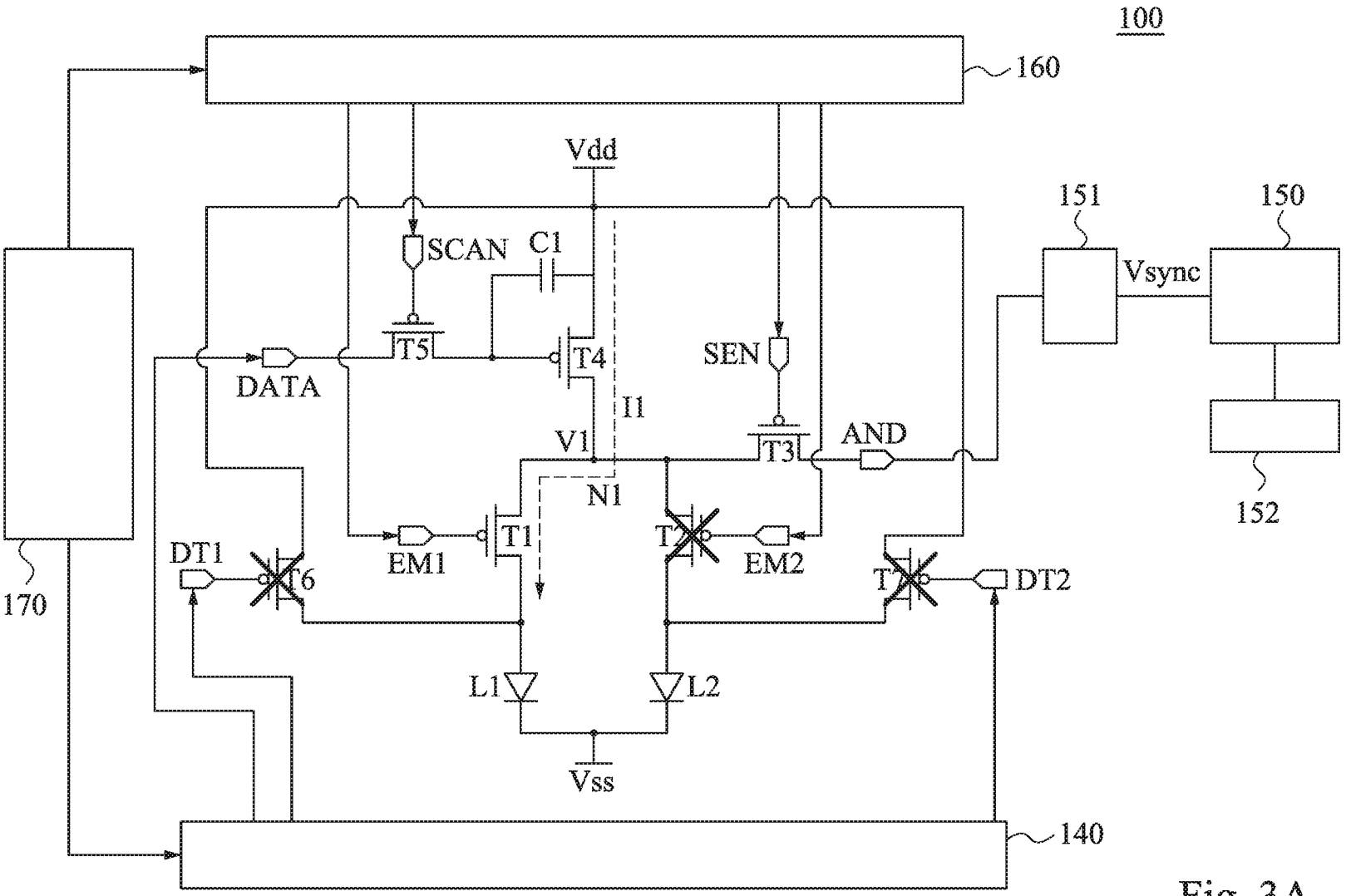
FIG. 3A-3E are schematic diagrams of the operation state of the pixel circuit in some embodiments of the present disclosure.

FIG. 2 is a flowchart of a pixel circuit repair method 200 in some embodiments of the present disclosure. In step S210, the detection circuit 150 determines the states of the first light emitting element L1 and the second light emitting element L2. In some embodiments, the scan driver 160 outputs a first enable signal to the gate control terminal of the first transistor switch T1 to turn on the first transistor switch T1, and outputs a second disable signal to the gate control terminal of the second transistor switch T2 to turn off the second transistor switch T2. In some embodiments, the compensation circuit 140 outputs a sixth disable signal to the gate control terminal of a first compensation switch T6 to turn off the first compensation switch T6, and outputs a seventh disable signal to the gate control terminal of a second compensation switch T7 to turn off the second compensation switch T7. As shown in FIG. 3A, the detection circuit 150 is configured to detect the first detection voltage V1 on the first lighting circuit 110.

Figure 3B:
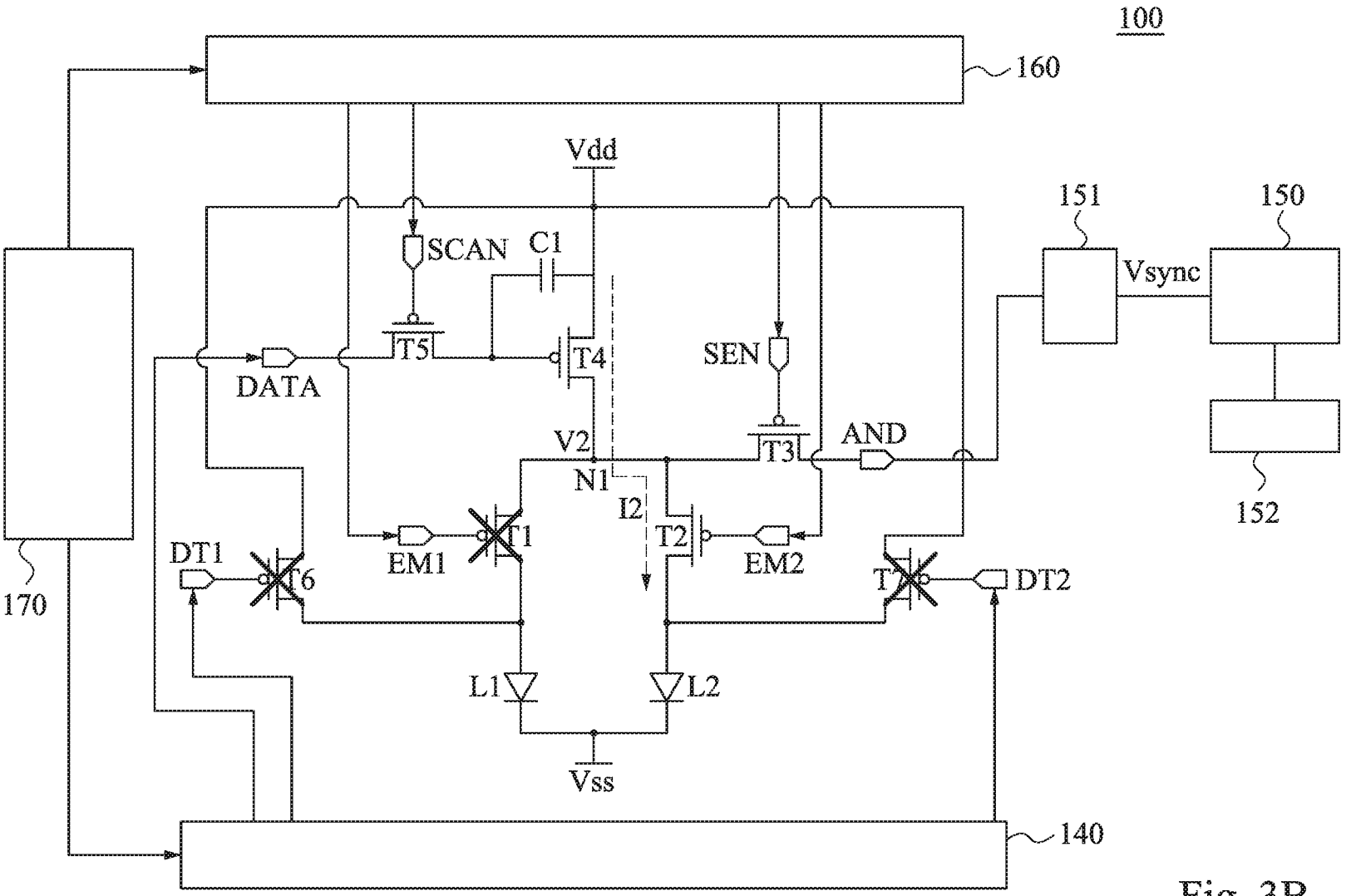

As shown in FIG. 3B, the scan driver 160 outputs the first disable signal to turn off the first transistor switch T1, and outputs a second enable signal to turn on the second transistor switch T2. In some embodiments, the compensation circuit 140 outputs the sixth disable signal to the gate control terminal of the first compensation switch T6 to turn off the sixth transistor switch T6, and outputs the seventh disable signal to the gate control terminal of the second compensation switch T7 to turn off the seventh transistor switch T7. Then, the detection circuit 150 can detect the second detection voltage V2 of the second lighting circuit 120. In some embodiments, the detection circuit 150, the first lighting circuit 110 and the second lighting circuit 120 are all electrically connected to the driving circuit 130 through the first node N1 so as to receive the power supply voltage Vdd through the driving circuit 130. In addition, the first lighting circuit 110 and the second lighting circuit 120 are also electrically connected to the reference potential Vss. That is, the first lighting circuit 110 and the second lighting circuit 120 are connected in parallel. Since the first transistor switch T1 and the second transistor switch T2 have a low cross voltage when turned on, after the detection circuit 150 detects the first detection voltage V1 and the second detection voltage V2, the cross voltage of the first light emitting element L1 and the cross voltage of the second light emitting element L2 can be calculated according to the power supply voltage Vdd and the reference voltage Vss.

In some embodiments, the detection circuit 150 is electrically connected to the first node N1 (or the first lighting circuit 110 and the second lighting circuit 120) through the analog-to-digital circuit 151 and the third transistor switch T3. The scan driver 160 is configured to control the opening and closing of the third transistor switch T3 so that the detection circuit 150 can detect the voltage of the first node N1.

In step S220, based on the first detection voltage V1 and the second detection voltage V2, the detection circuit 150 determines whether repair is necessary, according to the states of the first light emitting element L1 and the second light emitting element L2. In some embodiments, the detection circuit 150 determines whether the first detection voltage V1 and the second detection voltage V2 are within the standard voltage range (e.g., a standard voltage is between 2.0-3.5 volts) to confirm whether the first light emitting element L1 and the second light emitting element L2 are working normally state. In the case of the first detection voltage V1 is outside (e.g., higher or lower) the standard voltage range, it represents the first light emitting element L1 works abnormally state (e.g., open circuit or short circuit). Similarly, in the case of the second detection voltage V2 is higher or lower than the standard voltage range, it represents the second light emitting element L2 abnormality.

Figure 3C:
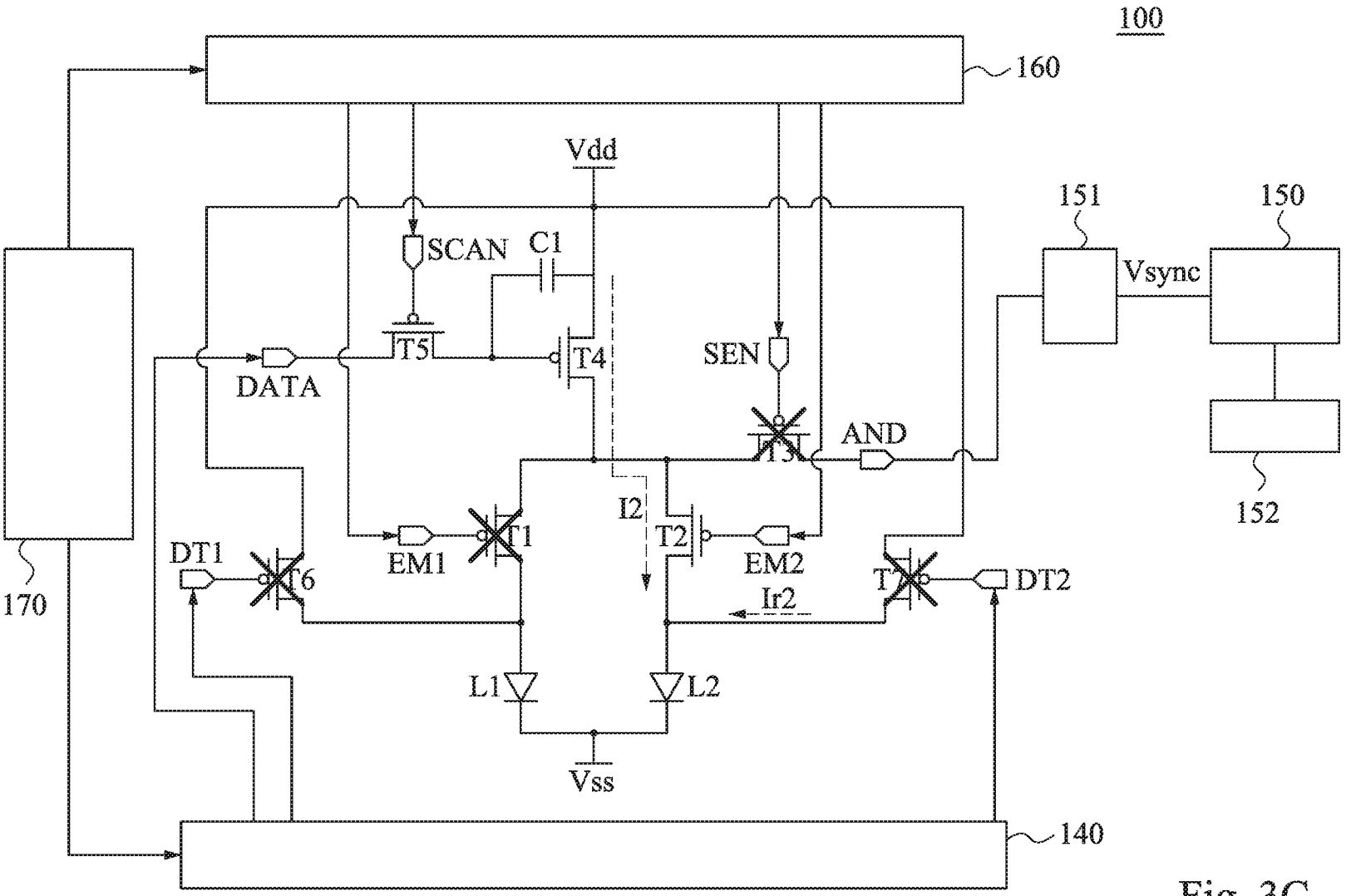
Figure 3D:
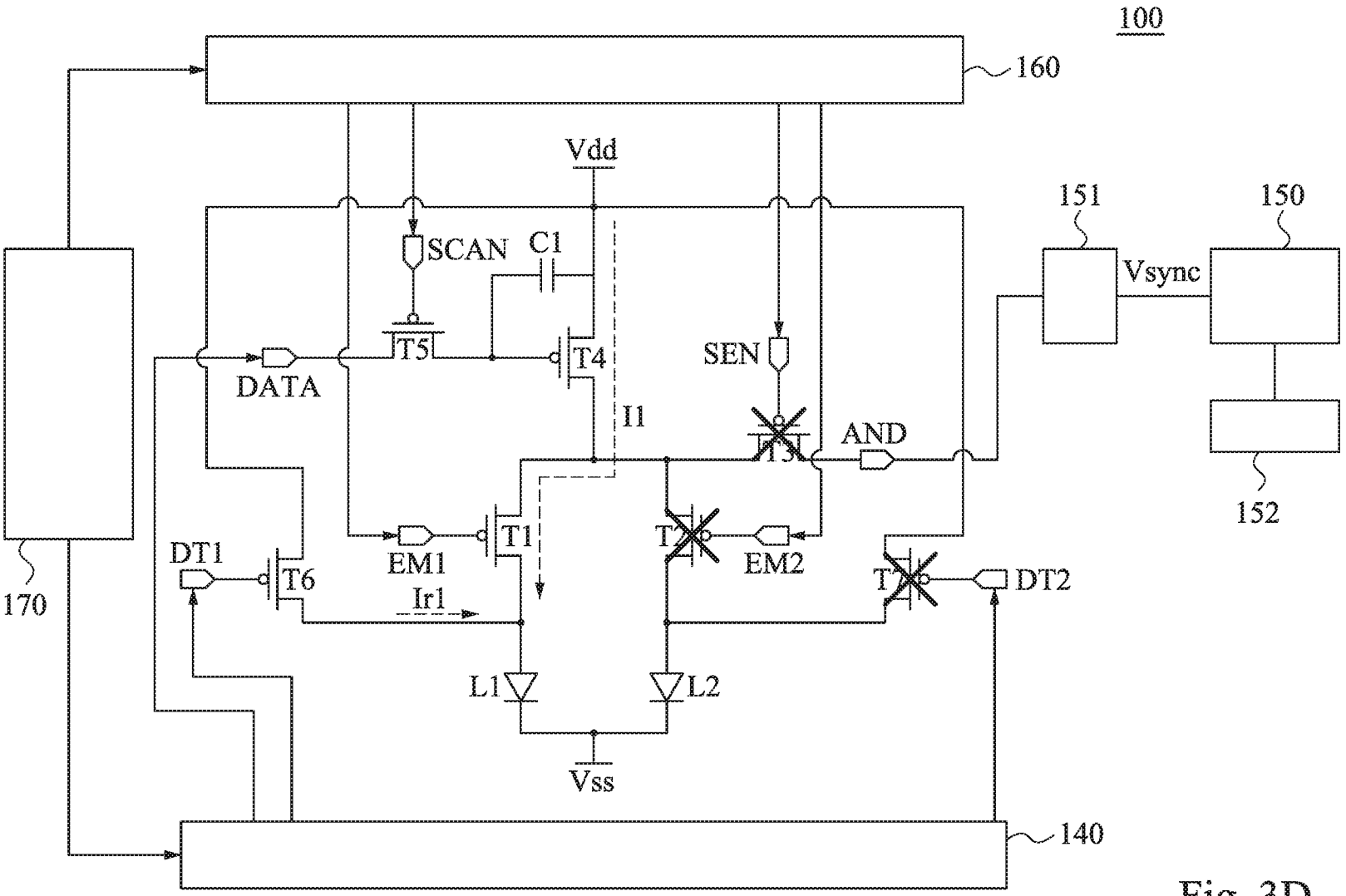

The pixel circuit 100 will repair the first lighting circuit 110 or the second lighting circuit 120 when the first light emitting element L1 or the second light emitting element L2 is abnormal. In step S250, the first lighting circuit or/and the second lighting circuit are driven by the driving circuit 130. As shown in FIG. 3C, if the first light emitting element L1 is abnormal, the scan driver 160 transmits the first disable signal to turn off the first transistor switch T1. Similarly, as shown in FIG. 3D, in the case of the second detection voltage V2 is higher or lower than the standard voltage range, it represents the second light emitting element L2 is abnormal or damaged. At this time, the scan driver 160 transmits the second disable signal to turn off the second transistor switch T2.

If the detection circuit 150 determines that the states of the first light emitting element L1 and the second light emitting element L2 are normal, in order to avoid the impedance values of the first light emitting element L1 and the second light emitting element L2 changing due to the ohmic contact effect, in step S230, the detection circuit 150 establishes corresponding electrical property data for the first light emitting element L1 and the second light emitting element L2, respectively. In some embodiments, the detection circuit 150 generates a first electrical property data according to the first driving current I1 and the first detection voltage V1, and generates a second electrical property data according to the second driving current I2 and the second detection voltage V2. The detection circuit calculates a difference in impedance between the first lighting circuit 110 and the second lighting circuit 120 according to the first electrical property data and the second electrical property data. The method of establishing electrical property data will be explained in the following paragraphs.

Figure 3E:
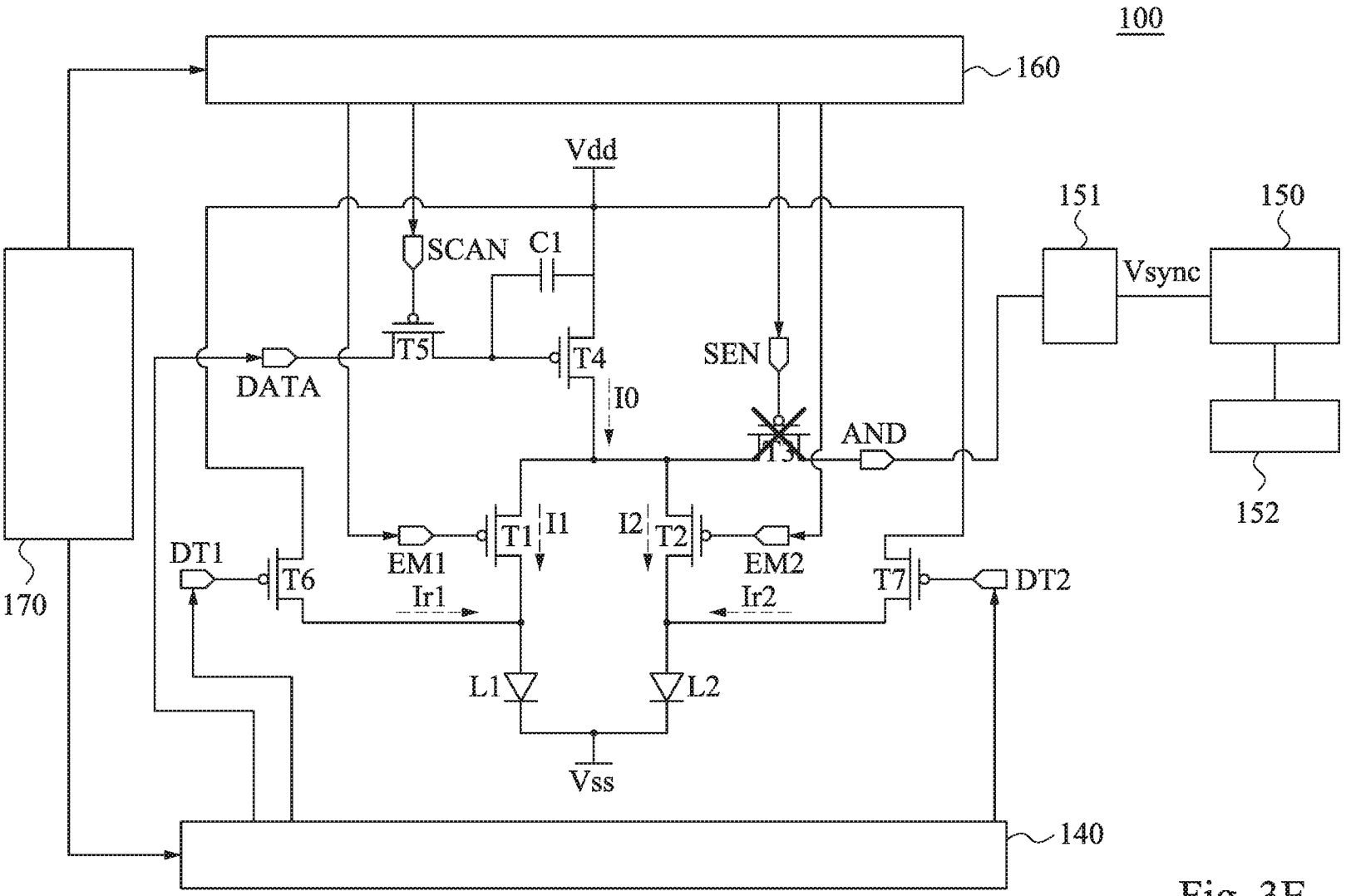

As shown in FIG. 3E, after the detection circuit 150 calculates the difference in impedance between the first lighting circuit 110 and the second lighting circuit 120 according to the electrical property data, in step S240, the compensation circuit 140 selectively provides the first compensation current L1 to the first light emitting element L1 according to the difference in impedance between the first lighting circuit 110 and the second lighting circuit 120, or provide the second compensation current L2 to the second light emitting element L2. Finally, in step S250, the driving circuit 130 drives the first lighting circuit 110 and/or the second lighting circuit 120.

In some embodiments, the driving circuit 130 includes a first capacitor C1, a fourth transistor switch T4, and a fifth transistor switch T5. The first terminal of the fourth transistor switch T4 is configured to receive the power supply voltage Vdd through the driving circuit 130, and the second terminal of the fourth transistor switch T4 is electrically connected to the first lighting circuit 110 and the second lighting circuit 120. The first capacitor C1 is electrically connected between the supply voltage Vdd and the gate control terminal of the fourth transistor switch T4. The fifth transistor switch T5 is electrically connected to the gate control terminal of the fourth transistor switch T4 for controlling the fourth transistor switch T4 to be turned on or off. The pixel circuit 100 of the present disclosure is configured to detect and repair the first light emitting element L1 and the second light emitting element L2, and thus may be applied to various types of the driving circuit 130. That is, the circuit structure of the driving circuit 130 is not limited as shown in FIG.

Referring to FIG. 1, in some embodiments, the compensation circuit 140 may include a source data driver, and provides the compensation current through the first compensation switch T6 and the second compensation switch T7. The first compensation switch T6 is electrically connected to the first light emitting element L1. When the first compensation switch T6 is turned on, the compensation circuit 140 provides the first compensation current Ir1 to the first light emitting element L1. The second compensation switch T7 is electrically connected to the second light emitting element L2. When the second compensation switch T7 is turned on, the compensation circuit 140 provides the second compensation current Ir2 to the second light emitting element L2. As described above, the compensation circuit 140 provides the first compensation current Ir1 or the second compensation current Ir2 according to the difference in impedance between the first lighting circuit 110 and the second lighting circuit 120, so that the current flowing through the first light emitting element L1 is the same as the current flowing through the second light emitting element L2.

In the foregoing embodiment, the compensation circuit 140 provides the compensation current to the first light emitting element L1 or the second light emitting element L2 through the first compensation switch T6 and the second compensation switch T7, respectively. However, in other embodiments, the source driver in the compensation circuit 140 may be electrically connected to the first lighting circuit 110 or the second lighting circuit 120 through a single switch unit. Accordingly, the compensation circuit 140 can selectively provide the compensation current according to the impedance difference between the first lighting circuit 110 and the second lighting circuit 120 to ensure brightness is consistent.

In some embodiments, when the first light emitting element L1 or the second light emitting element L2 is abnormal, as described above, the scan driver 160 turns off the first transistor switch T1 or the second transistor switch T2, so that the driving circuit 130 only drives the normal first light emitting element L1 or the normal second light emitting element L2. At this time, since only one light emitting element generates light, the compensation circuit 140 can increase the current on the normal operating light emitting element to maintain the same brightness.

For example, when the first light emitting element L1 is abnormal, the first transistor switch T1 will be turned off, and the second transistor switch T2 will be turned on. At this time, the compensation circuit 140 turns on the second compensation switch T7, and adjusts the second compensation current to the amount of the first driving current when the first light emitting element L1 is normal. Similarly, when the second light emitting element L2 is abnormal, the first transistor switch T1 will be turned on, and the second transistor switch T2 will be turned off. At this time, the compensation circuit 140 turns on the first compensation switch T6, and adjusts the first compensation current to the amount of the second driving current when the second light emitting element L2 is normal.

Figure 4:
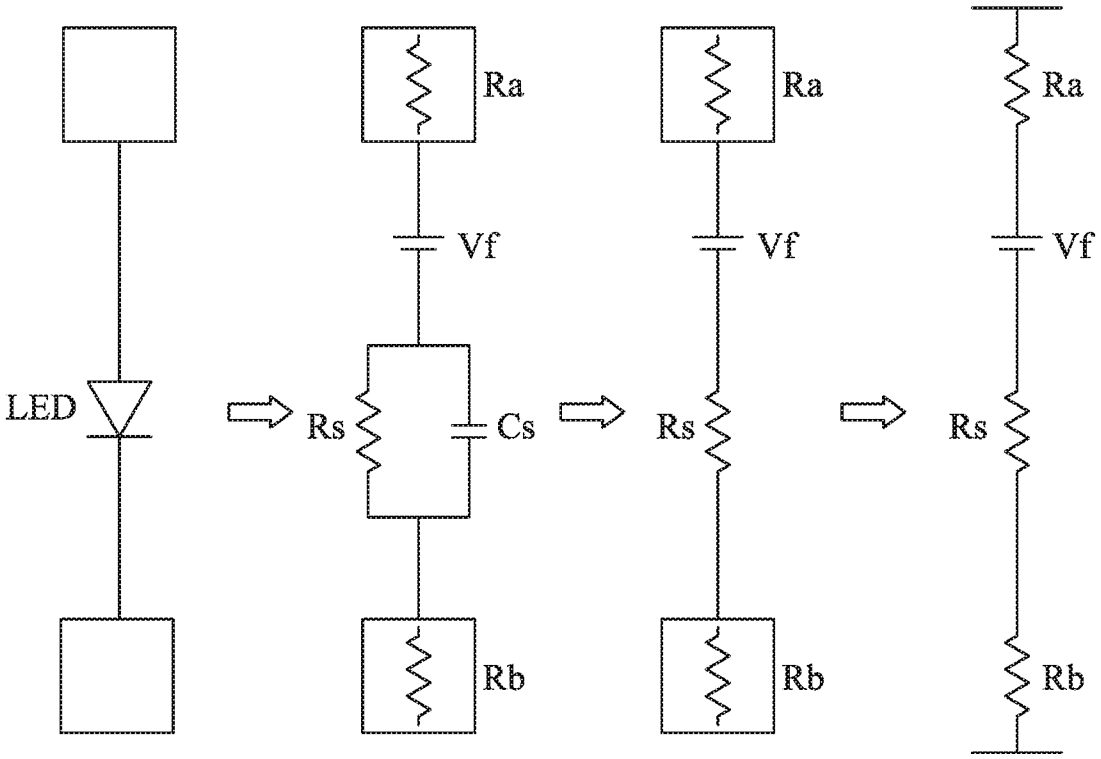
FIG. 4 is a schematic diagram of an equivalent circuit of the light emitting diode in some embodiments of the present disclosure.

Referring to FIG. 4, the method for calculating the difference between the impedance of the first lighting circuit 110 and the second lighting circuit 120 is described herein. The LED can be equivalent to a voltage source Vf and a resistor Rs and a capacitor Cs connected in parallel according to its electronic characteristics. In the DC analysis of the circuit, the capacitance Cs can be considered as an open circuit. Since the micro LEDs are disposed on the first lighting circuit 110 and the second lighting circuit 120 after the circuit wiring on the pixel circuit 100 is completed, the two pads of the LED will generate additional resistance Ra, Rb due to ohmic contact. The resistances Rs, Ra, and Rb are the equivalent impedance values of the light emitting diodes. In the case of the reference voltage Vss is at a zero electrical potential, the first detection voltage V1 and the second detection voltage V2 detected by the detection circuit 150 are equivalent to the cross voltage of the first lighting circuit 110 and the second lighting circuit 120.

In some embodiments, the detection circuit 150 can modify the driving current DATA to change the amount of the driving current I0. The detection circuit 150 further detects the voltage of the first node N1 to generate the first electrical property data corresponding to the first lighting circuit 110 and the second electrical property data corresponding to the second lighting circuit 120, respectively. As shown in FIG. 3A, when the second transistor switch T2 is turned off, the driving current I0 is equal to the first driving current I1. Therefore, the detection circuit 150 can adjust the amount of the first driving current I1, and detect the corresponding first detection voltage V1 to generate the first electrical property data.

Figure 5:
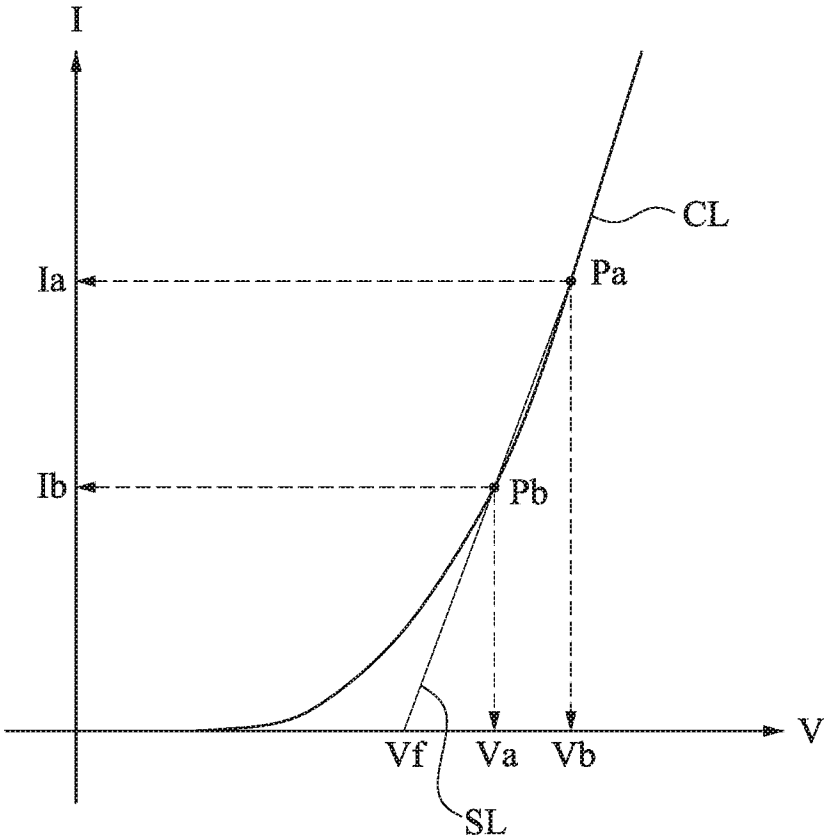
FIG. 5 is a schematic diagram of the characteristic curve and sampling line of the light emitting diode in some embodiments of the present disclosure.

In some embodiments, the first electrical property data contain a characteristic curve of the light emitting diode. As shown in FIG. 5, in actual operation, the current characteristics of the LED at different voltages are nonlinear curves CL. The detection circuit 150 selects two sampling points Pa, Pb on the curve CL. The sampling currents 1*a*, 1*b* corresponding to the sampling points Pa, Pb can be set by the pixel circuit 100, and thus are known data. The sampling voltages Va and Vb corresponding to the sampling points Pa and Pb are the first detection voltage V1 on the first node N1 detected by the detection circuit 150, which is also known data. Therefore, after confirming the sampling voltages Va, Vb and the sampling currents 1*a*, 1*b*, the detecting circuit 150 can obtain a first sampling line SL on the curve CL. The intersection point of the first sampling line SL corresponding to the horizontal axis is the voltage source Vf in the equivalent circuit of the LED. The detection circuit 150 calculates the first impedance value Rt1 of the first lighting circuit 110 according to the slope of the first sampling line SL (the inverse of the slope of the first sampling line SL is the first impedance value Rt1).

Similarly as shown in FIG. 3B, the detection circuit 150 can modify the amount of the second driving current I2 when the first transistor switch T1 is turned off, and detect the second detection voltage V2 when the second driving current I2 is different, so that the detection circuit 150 may obtain the second sampling line. The detection circuit 150 calculates the second impedance value Rt2 of the second lighting circuit 120 according to the slope of the second sampling line.

As shown in FIG. 3E, in the case of the first transistor switch T1 and the second transistor switch T2 are both turned on, the equivalent total impedance of the path of the first transistor switch T1 is Rtotal1=(Rt1+Ra+Rb). The equivalent total impedance of the path of the second transistor switch T2 is Rtotal2=(Rt2+Ra+Rb). Therefore, the driving current I0 will be divided into the first driving current I1 and the second driving current I2 according to the current divider rule:

$$I1=I0\times R\text{total}2/(R\text{total}1+R\text{total}2)$$

$$I2=I0\times R\text{total}1/(R\text{total}1+R\text{total}2)$$

According to the above formula, the detection circuit 150 can confirm the difference between the first driving current I1 and the second driving current I2. If the first driving current I1 is larger than the second driving current I2, the compensation circuit 140 provides the second compensation current L2 to the second light emitting element L2. On the other hand, if the first driving current I1 is less than the second driving current I2, the compensation circuit 140 provides the first compensation current Ir1 to the first light emitting element L1. Accordingly, it is ensured that the current flowing through the first light emitting element L1 is the same as the current flowing through the second light emitting element L2.

Referring to FIG. 1, in some embodiments, the pixel circuit 100 further includes a timing controller 170 for controlling the source driver, the scan driver 160 and the compensation circuit 140. In addition, the detection circuit 150 is electrically connected to the first node N1 through the analog-to-digital circuit 151 and the anode-side voltage detection signal AND (Anode Detect). The detected voltage signal is converted to a digital signal by the analog-to-digital circuit 151. The detection circuit 150 is also electrically connected to the storage unit 152 (e.g., memory). The storage unit 152 is configured to store the first detection voltage V1, the second detection voltage V2 detected by the detection circuit 150 and the foregoing electrical characteristic data.

FIG. 1 shows the pixel circuit 100 for displaying a pixel. Since a frame contains a lot of pixels, in some embodiments, the detection circuit 150 can be used to simultaneously detect multiple detection voltages on multiple pixel circuits 100. In other embodiments, the detection circuit 150, the analog-to-digital circuit 151 and the storage unit 152 can be provided in a detection device. The detection device is independent of the display device. Therefore, the user only needs to periodically connect the detection device to the display device to periodically detect and repair the pixel circuit 100.

In some embodiments, as shown in FIG. 1, the first transistor switch T1, the second transistor switch T2, the third transistor switch T3, the fourth transistor switch T4, the fifth transistor switch T5, the first compensation switch T6 and the second compensation switch T7 used in the pixel circuit 100 are all P-type MOSFETs. That is, when the signals received by the gate control terminals of those switches are at a low electrical potential, those transistors will be turned on. On the other hand, when the signals received by the gate control terminals of those switches are at a high electrical potential, those transistor switches will be turned off. However, the disclosure is not limited thereto, and N-type MOSFETs can also be used.

Figure 6:
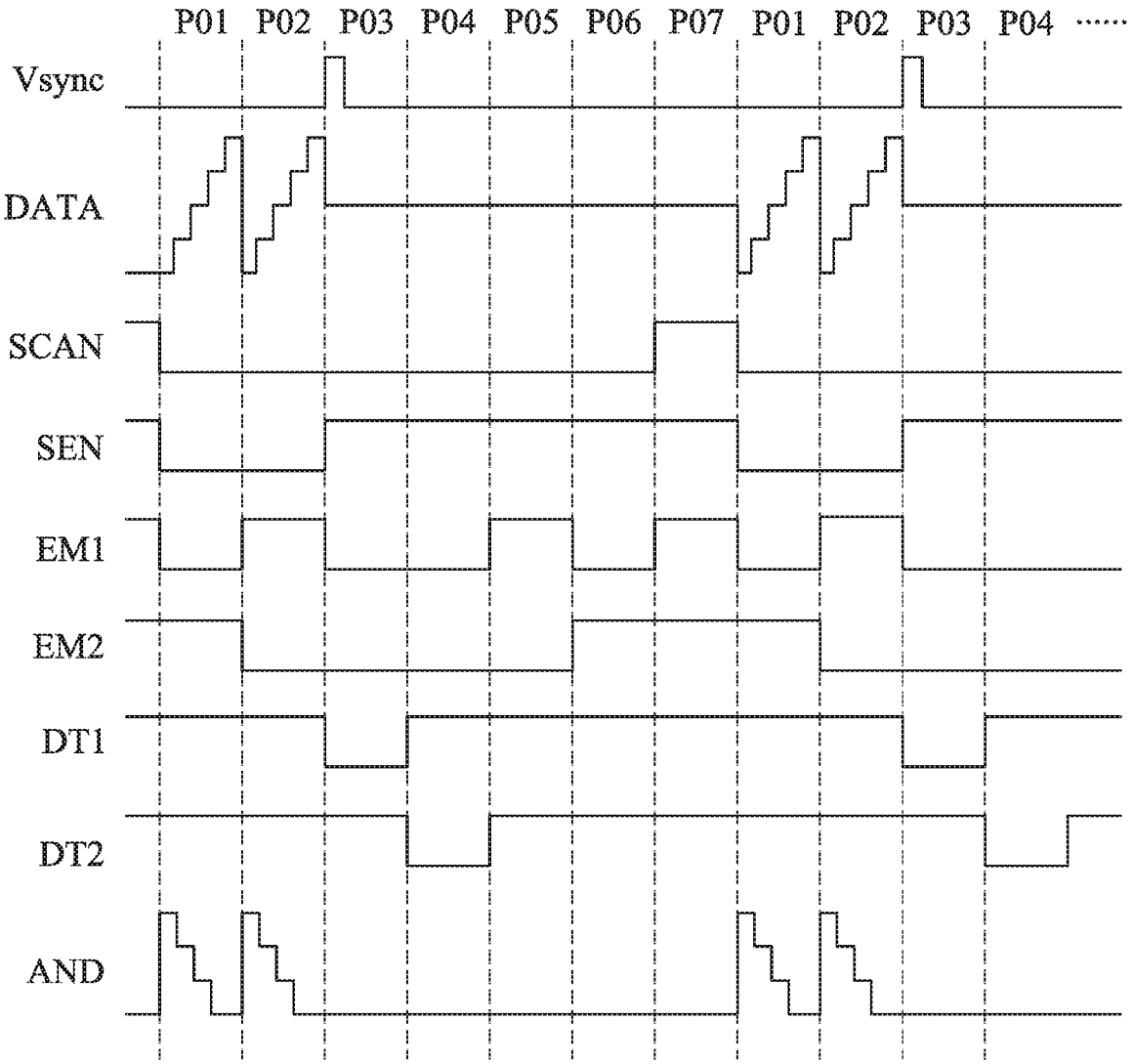
FIG. 6 is a waveform diagram of the pixel circuit in some embodiments of the present disclosure.

FIG. 6 is a waveform diagram of the pixel circuit 100. Vsync is a trigger signal that the analog-to-digital circuit 151 outputs to the detection circuit 150. DATA is the drive signal that the compensation circuit 140 outputs to the driving circuit 130. SEN is the control signal that the scan driver 160 outputs to the third transistor switch T3. The SCAN is a scan signal that the scan driver 160 outputs to the driving circuit 130. EM1 and EM2 are control signals output by the scan driver 160 to the first transistor switch T1 and the second transistor switch T2, respectively. DT1 and DT2 are control signals output by the compensation circuit 140 to the first compensation switch T6 and the second compensation switch T7, respectively. The values of the high electrical potential and low electrical potential of each signal in the waveform diagram are shown in Table 1 below:

TABLE 1

| | | |
|---|---|---|
| Vsync | high electrical potential | 3.3 |
| | low electrical potential | 0 |
| DATA | high electrical potential | 10 |
| | low electrical potential | 0 |
| SCAN | high electrical potential | 15 |
| | low electrical potential | −5 |
| SEN | high electrical potential | 15 |
| | low electrical potential | −5 |
| EM1 | high electrical potential | 15 |
| | low electrical potential | −5 |
| EM2 | high electrical potential | 15 |
| | low electrical potential | −5 |
| DT1 | high electrical potential | 10 |
| | low electrical potential | 0 |
| DT2 | high electrical potential | 10 |
| | low electrical potential | 0 |
| AND | high electrical potential | 3 |
| | low electrical potential | 0 |

The seven time segments P01 to P07 shown in FIG. 6 represent waveforms of the seven operational states of the pixel circuit 100, respectively. In other embodiments of the present disclosure, the pixel circuit 100 is not limited to continuously performing the operational states. That is, the pixel circuit 100 may only selectively performs a partial operation state according to the normal or abnormality of the first lighting circuit 110 and the second lighting circuit 120. In the time segment P01, the first transistor switch T1 is turned on according to the control signal EM1. The third transistor switch T3 and the fifth transistor switch T5 are turned on according to the control signals SEN, SCAN. The second transistor switch T2, the first compensation switch T6 and the second compensation switch T7 are turned off according to the control signals EM2, DT1, DT2. At this time, the detection circuit 150 is configured to detect the first voltage V1 (as shown in FIG. 3A), and the driving circuit 130 generates different amount of the driving current I0 according to the driving signal DATA, so that the detecting circuit 150 can generate the first electrical property data. Similarly, in the time segment P02 and the second transistor switch T2 are turned on according to the control signal EM2. The third transistor switch T3 and the fifth transistor switch T5 are turned on according to the control signals SEN, SCAN. The first transistor switch T1, the first compensation switch T6 and the second compensation switch T7 are turned off according to the control signals EM1, DT1, DT2. At this time, the detection circuit 150 is configured to detect the second voltage V2 (as shown in FIG. 3B). The driving circuit 130 generates different amount of the driving current I0 according to the driving signal DATA, so that the detecting circuit 150 can generate the second electrical property data. That is, in the time segments P01 and P02, the pixel circuit 100 is configured to establish the electrical characteristics data of the first light emitting element L1 and the second light emitting element L2.

As shown in FIG. 3E, in the time segment P03, the first transistor switch T1 and the second transistor switch T2 are both turned on. The first compensation switch T6 is turned on to provide the first compensation current Ir1 to the first light emitting element L1. Similarly, in the time segment P04, the first transistor switch T1 and the second transistor switch T2 are both turned on. The second compensation switch T7 is turned on to provide the second compensation current Ir2 to the second light emitting element L2.

In time segment P05, when the first light emitting element L1 is damaged, the first transistor switch T1 will be turned off according to the control signal EM1, and the second transistor switch T2 is turned on, so that only the second light emitting element L2 is driven. Similarly, in the time segment P06, when the second light emitting element L2 is damaged, the second transistor switch T2 will be turned off according to the control signal EM2, and the first transistor switch T1 is turned on, so that only the first light emitting element L1 is driven. In the time segment P07, the first transistor switch T1 and the second transistor switch T2 are both turned off, which means that the first light emitting element L1 and the second light emitting element L2 are both damaged. Therefore, the pixel circuit 100 will stop driving the driving circuit 130 by scanning the signal SCAN.

Accordingly, the present disclosure not only repairs the first lighting circuit 110 or the second lighting circuit 120 by detecting the voltage, but also calculates the difference in impedance between the first lighting circuit 110 and the second lighting circuit 120 according to the amount of the detected voltage, so that the present disclosure may selectively provide the compensation current to ensure that the currents on the first lighting circuit 110 or the second lighting circuit 120 are the same. In this way, it will be ensured that when the first light emitting element L1 and the second light emitting element L2 are simultaneously driven, the generated light may be the same as each other.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A pixel circuit, comprising:

a first lighting circuit comprising a first light emitting element and a first transistor switch, wherein the first light emitting element receives a first driving current from a driving circuit when the first transistor switch is turned on;

a second lighting circuit comprising a second light emitting element and a second transistor switch, wherein the second light emitting element receives a second driving current from the driving circuit when the second transistor switch is turned on;

a compensation circuit electrically connected to the first light emitting element and the second light emitting element, wherein when the first light emitting element and the second light emitting element are driven by the first driving current and the second driving current, the compensation circuit provides a compensation current to the first light emitting element or the second light emitting element according to a difference in impedance between the first light emitting circuit and the second light emitting circuit; and a detection circuit electrically connected to the first transistor switch and the second transistor switch, wherein the detection circuit is configured to detect a first detection voltage of the first lighting circuit when the first transistor switch is turned on and the second transistor switch is turned off, or configured to detect a second detection voltage of the second lighting circuit when the first transistor switch is turned off and the second transistor switch is turned on.

2. The pixel circuit of claim 1, wherein when the first detection voltage is outside a standard voltage range, the first transistor switch turned off according to a first disable signal; when the second detection voltage is outside the standard voltage range, the second transistor switch turned off according to a second disable signal.

3. The pixel circuit of claim 1, wherein the detection circuit is configured to generate a first electrical property data according to the first driving current and the first detection voltage, and is configured to generate a second electrical property data according to the second driving current and the second detection voltage; the detection circuit is further configured to calculate the difference in impedance between the first light emitting circuit and the second light emitting circuit according to the first electrical property data and the second electrical property data.

4. The pixel circuit of claim 3, wherein the detection circuit is configured to calculate a first impedance value of the first lighting circuit and a second impedance value of the second lighting circuit according to a slope of a sampling line of the first electrical property data and the second electrical property data, and the detection circuit is further configured to calculate the compensation current according to current divider rule.

5. The pixel circuit of claim 1, further comprising:

a first compensation switch electrically connected to the first light emitting element, wherein when the first compensation switch is turned on, the compensation circuit is configured to provide a first compensation current to the first light emitting element; and a second compensation switch electrically connected to the second light emitting element, wherein when the second compensation switch is turned on, the compensation circuit is configured to provide a second compensation current to the second light emitting element.

6. The pixel circuit of claim 5, wherein when the first transistor switch is turned off and the second transistor switch is turned on, the second compensation switch is turned on and an amount of the second compensation current is equal to an amount of the first driving current.

7. A pixel circuit repair method, comprising:

Turning on a first transistor switch of a first lighting circuit so that a first light emitting element is driven by a first driving current;

detecting a first detection voltage of the first lighting circuit;

Turning on a second transistor switch of a second lighting circuit and turning off the first transistor switch of the first lighting circuit so that a second light emitting element is driven by a second driving current;

detecting a second detection voltage of the second lighting circuit; and providing a compensation current to the first light emitting element of the second light emitting element through a compensation circuit according to a difference in impedance between the first light emitting circuit and the second light emitting circuit; wherein the pixel circuit repair method further comprises:

modifying an amount of the first driving current and detecting the first detection voltage to generate a first electrical property data;

modifying an amount of the second driving current and detecting the second detection voltage to generate a second electrical property data; and calculating the difference in impedance between the first light emitting circuit and the second light emitting circuit according to the first electrical property data and the second electrical property data.

8. The pixel circuit repair method of claim 7, further comprising:

Turning off the first transistor switch when the first detection voltage is outside a standard voltage range; and Turning off the second transistor switch when the second detection voltage is outside the standard voltage range.

9. The pixel circuit repair method of claim 7, further comprising:

calculating a first impedance value of the first lighting circuit according to a slope of a first sampling line of the first electrical property data;

calculating a second impedance value of the second lighting circuit according to a slope of a second sampling line of the second electrical property data; and calculating the compensation current according to current divider rule.

10. The pixel circuit repair method of claim 7, further comprising:

providing the compensation current to the second lighting circuit when the first transistor switch is turned off and the second transistor switch is turned on, and an amount of the compensation current is equal to an amount of the first driving current.

11. A pixel circuit, comprising:

a first lighting circuit comprising a first light emitting element and a first transistor switch, wherein when the first transistor switch is turned on, the first light emitting element receives a first driving current from a driving circuit;

a second lighting circuit comprising a second light emitting element and a second transistor switch, wherein when the second transistor switch is turned on, the second light emitting element receives a second driving current from the driving circuit;

a detection circuit electrically connected to the first lighting circuit and the second lighting circuit, and configured to detect a first detection voltage of the first lighting circuit and a second detection voltage of the second lighting circuit; and a compensation circuit electrically connected to the first lighting circuit and the second lighting circuit, and configured to provide a compensation current to the first light emitting element or the second light emitting element according to the first detection voltage and the second detection voltage; wherein the detection circuit is configured to generate a first electrical property data according to the first driving current and the first detection voltage, and is configured to generate a second electrical property data according to the second driving current and the second detection voltage; the detection circuit is further configured to calculate a difference in impedance between the first light emitting circuit and the second light emitting circuit according to the first electrical property data and the second electrical property data.

12. The pixel circuit of claim 11, wherein when the first light emitting element is driven by the first driving current and the second light emitting element is driven by the second driving current, the compensation circuit selectively provides the compensation current to the first light emitting element or the second light emitting element.

13. The pixel circuit of claim 11, wherein when the first detection voltage is outside a standard voltage range, the first transistor switch turned off according to a first disable signal; when the second detection voltage is outside the standard voltage range, the second transistor switch turned off according to a second disable signal.

14. The pixel circuit of claim 11, wherein the detection circuit is configured to calculate a first impedance value of the first lighting circuit and a second impedance value of the second lighting circuit according to a slope of a sampling line of the first electrical property data and the second electrical property data, and the detection circuit is further configured to calculate the compensation current according to current divider rule.

15. The pixel circuit of claim 11, wherein the first lighting circuit, the second lighting circuit and the detection circuit are electrically connected to the driving circuit through a first node.

16. The pixel circuit of claim 11, further comprising:

a first compensation switch electrically connected to the first light emitting element, wherein when the first compensation switch is turned on, the compensation circuit is configured to provide a first compensation current to the first light emitting element; and a second compensation switch electrically connected to the second light emitting element, wherein when the second compensation switch is turned on, the compensation circuit is configured to provide a second compensation current to the second light emitting element.

17. The pixel circuit of claim 16, wherein when the first transistor switch is turned off and the second transistor switch is turned on, the second compensation switch is turned on and an amount of the second compensation current is equal to an amount of the first driving current.

* * * * *